US011850718B2

(12) United States Patent
Kerson et al.

(10) Patent No.: US 11,850,718 B2
(45) Date of Patent: Dec. 26, 2023

(54) MULTI-TOOLS

(71) Applicant: PNW Components, LLC, Seattle, WA (US)

(72) Inventors: Aaron Kerson, Seattle, WA (US); Adam Hammerman, Cham (CH)

(73) Assignee: PNW Components, LLC, Seattle, WA (US)

( * ) Notice: Subject to any disclaimer, the term of this patent is extended or adjusted under 35 U.S.C. 154(b) by 0 days.

(21) Appl. No.: 17/568,613

(22) Filed: Jan. 4, 2022

(65) Prior Publication Data

US 2022/0212329 A1 Jul. 7, 2022

Related U.S. Application Data

(60) Provisional application No. 63/134,103, filed on Jan. 5, 2021.

(51) Int. Cl.
*B25F 1/04* (2006.01)
*B25F 1/00* (2006.01)

(52) U.S. Cl.
CPC ..... *B25F 1/04* (2013.01); *B25F 1/006* (2013.01); *B25F 1/003* (2013.01)

(58) Field of Classification Search
CPC .. B25F 1/04; B25F 1/006; B25F 1/003; B25F 1/00; B25F 5/029; B25G 1/08; B25G 1/085; B25B 27/0071; B25B 13/102; B25B 13/48
USPC ..... 81/440; 7/138, 168
See application file for complete search history.

(56) References Cited

U.S. PATENT DOCUMENTS

| | | | | |
|---|---|---|---|---|
| 2,828,855 | A * | 4/1958 | Mosch | B25F 1/04 206/374 |
| 5,711,042 | A * | 1/1998 | Chuang | B25B 13/56 7/138 |
| 9,061,470 | B2 * | 6/2015 | Cole | B29C 73/06 |
| 10,321,752 | B2 * | 6/2019 | Zentil | B25G 1/085 |
| 2008/0236210 | A1 * | 10/2008 | Frazer | B25F 1/04 7/128 |
| 2021/0187713 | A1 * | 6/2021 | Winefordner | B25B 13/5008 |

OTHER PUBLICATIONS

Amazon.com, "Real Avid Gun Tool Max, 37-in-1 Multitool for Gunsmithing, Includes Pliers, Wire Cutters, Knife Blade, Universal Choke Wrench, Bits, Wrenches & Sheath, Perfect EDC Tool for Hunting & Gun Owners", Jan. 23, 2017, URL=https://www.amazon.com/Real-Avid-Multitool-Tools-Sheath/dp/B01MY50OE7, download date Feb. 24, 2022. (8 pages).
Leatherman, "OHT", URL= https://www.leatherman.com/oht-49.html, download date Feb. 24, 2022. (5 pages).

* cited by examiner

*Primary Examiner* — Brian D Keller
*Assistant Examiner* — Abbie E Quann
(74) *Attorney, Agent, or Firm* — Seed IP Law Group LLP

(57) ABSTRACT

A multi-tool includes a plurality of individual tools such as four individual hex-head screwdrivers, a hexalobular internal screwdriver, and a tire repair tool, each of the individual tools rotatably coupled to a main body of the multi-tool. A distal portion of the hexalobular internal screwdriver may be nested within a proximal portion of the tire repair tool. When the multi-tool is in a closed configuration, a distal end of the tire repair tool may be located inside a distal end of a largest one of the hex-head screwdrivers.

16 Claims, 9 Drawing Sheets

MULTI-TOOLS

BACKGROUND

Technical Field

The present disclosure relates generally to multi-tools, and more particularly to multi-tools configured for use in repairing or otherwise working on bicycles.

Description of the Related Art

A wide variety of multi-tools are commercially available. The most widely-available multi-tools are often configured as all-purpose tools for use by as broad a range of consumers in as broad a range of applications as possible. They are therefore often equipped with a wide variety of individual tools, such as blades, screwdrivers, bottle openers, pliers, rulers, files, etc. Because many of these multi-tools are designed to maximize utility in a broad range of applications, they typically include more individual tools, and are typically larger and more expensive, than if they were more narrowly tailored for use in specific applications. While a wide variety of different multi-tools are already available, there is therefore room for improvement, especially with respect to multi-tools configured for use in specific fields or applications.

BRIEF SUMMARY

A multi-tool may be summarized as comprising: a first individual tool rotatable with respect to a main body of the multi-tool from a closed position of the first individual tool to an open position of the first individual tool; and a second individual tool rotatable with respect to the main body of the multi-tool from a closed position of the second individual tool to an open position of the second individual tool; wherein, when the first individual tool is in the closed position of the first individual tool and the second individual tool is in the closed position of the second individual tool, a distal end portion of the first individual tool is located inside a distal end portion of the second individual tool.

When the first individual tool is in the closed position of the first individual tool and the second individual tool is in the closed position of the second individual tool, the distal end portion of the first individual tool may be mechanically engaged with the distal end portion of the second individual tool. The first individual tool may be a tire repair tool. The tire repair tool may include a conical tip at the distal end portion of the tire repair tool and, when the first individual tool is in the closed position of the first individual tool and the second individual tool is in the closed position of the second individual tool, the conical tip may be seated within the distal end portion of the second individual tool. The tire repair tool may include a hollow tube and a plug, the plug located inside the hollow tube and securely coupled to the conical tip. The second individual tool may be a hex-head screwdriver. The multi-tool may include four hex-head screwdrivers and a hexalobular internal screwdriver. The multi-tool may include a hexalobular internal screwdriver and a distal end portion of the hexalobular internal screwdriver may be nested within a proximal end portion of the tire repair tool. The tire repair tool may be threaded onto the hexalobular internal screwdriver.

The hexalobular internal screwdriver may have a proximal portion directly coupled by a hinge to the main body of the multi-tool, a distal portion including a hexalobular internal screwdriver head, and an intermediate portion that couples the proximal portion to the distal portion, wherein the intermediate portion has an external surface including first threads; and the tire repair tool may include a hollow tube and a plug inside the hollow tube, wherein the hollow tube has an internal surface including second threads complementary to the first threads. The second individual tool may have a distal end surface and a recess formed in the distal end surface; and when the first individual tool is in the closed position of the first individual tool and the second individual tool is in the closed position of the second individual tool, a distal end portion of the first individual tool may be located inside the recess. The recess may include a distal cylindrical portion and a proximal conical portion.

A method of using a multi-tool including a main body, a first individual tool rotatable with respect to the main body, and a second individual tool rotatable with respect to the main body, may be summarized as comprising: rotating the first individual tool to a closed position of the first individual tool and rotating the second individual tool to a closed position of the second individual tool until a distal end portion of the first individual tool is located inside a distal end portion of the second individual tool.

Rotating the first individual tool to a closed position of the first individual tool and rotating the second individual tool to a closed position of the second individual tool may include simultaneously rotating the first individual tool and the second individual tool. The method may further comprise rotating the first individual tool to an open position of the first individual tool and rotating the second individual tool to an open position of the second individual tool until the distal end portion of the first individual tool is not located inside the distal end portion of the second individual tool. Rotating the first individual tool to an open position of the first individual tool and rotating the second individual tool to an open position of the second individual tool may include simultaneously rotating the first individual tool and the second individual tool. The first individual tool may be a first tire repair tool, and the method may further comprise: inserting the distal end portion of the first tire repair tool into a puncture in a tire; and retracting the first tire repair tool from the tire, leaving the distal end portion of the first tire repair tool inside the tire and a first plug of the first tire repair tool inside the puncture.

The method may further comprise: removing a hollow tube of the first tire repair tool from the multi-tool; and coupling a second tire repair tool to the multi-tool. The method may further comprise: inserting a distal end portion of the second tire repair tool into the puncture in the tire; and retracting the second tire repair tool from the tire, leaving the distal end portion of the second tire repair tool inside the tire and a second plug of the second tire repair tool inside the puncture. The method may further comprise trimming a portion of the first plug outside the tire and a portion of the second plug outside the tire.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Figure 1:
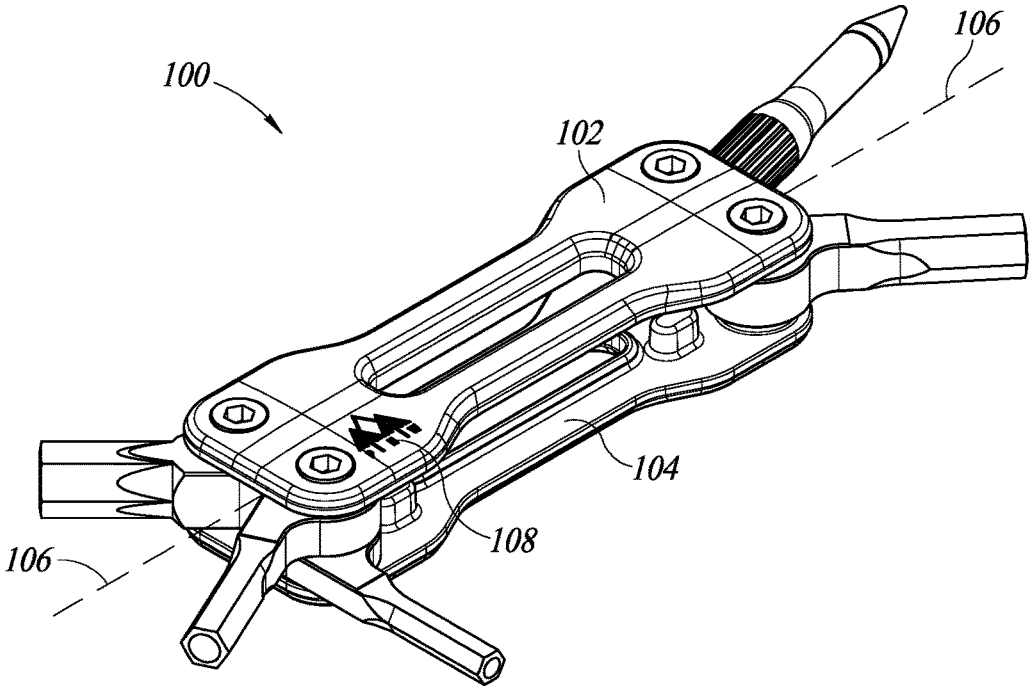
FIG. 1 illustrates a top perspective view of a multi-tool in an open configuration.
Figure 2:
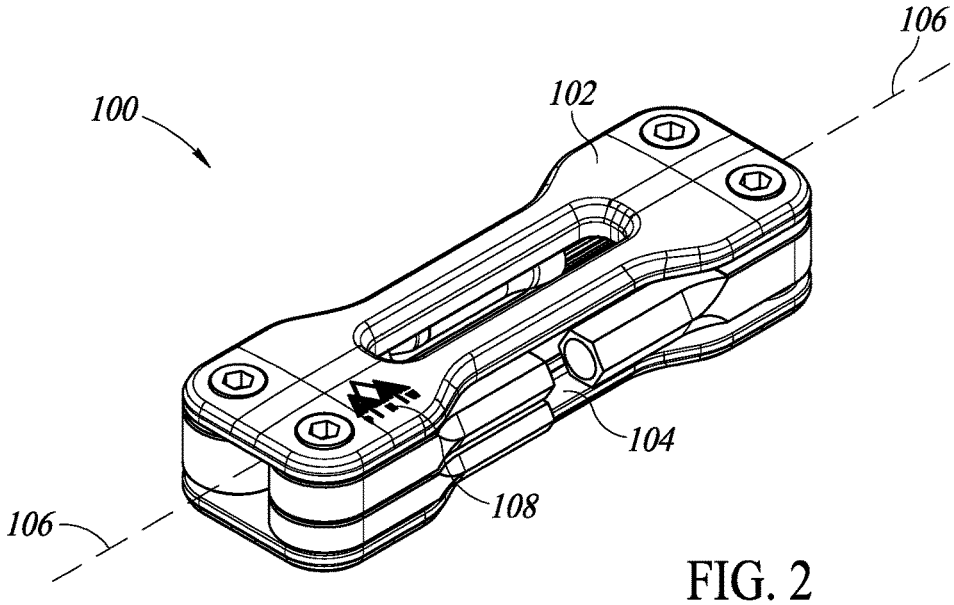
FIG. 2 illustrates a top perspective view of the multi-tool of FIG. 1 in a closed configuration.
Figure 3:
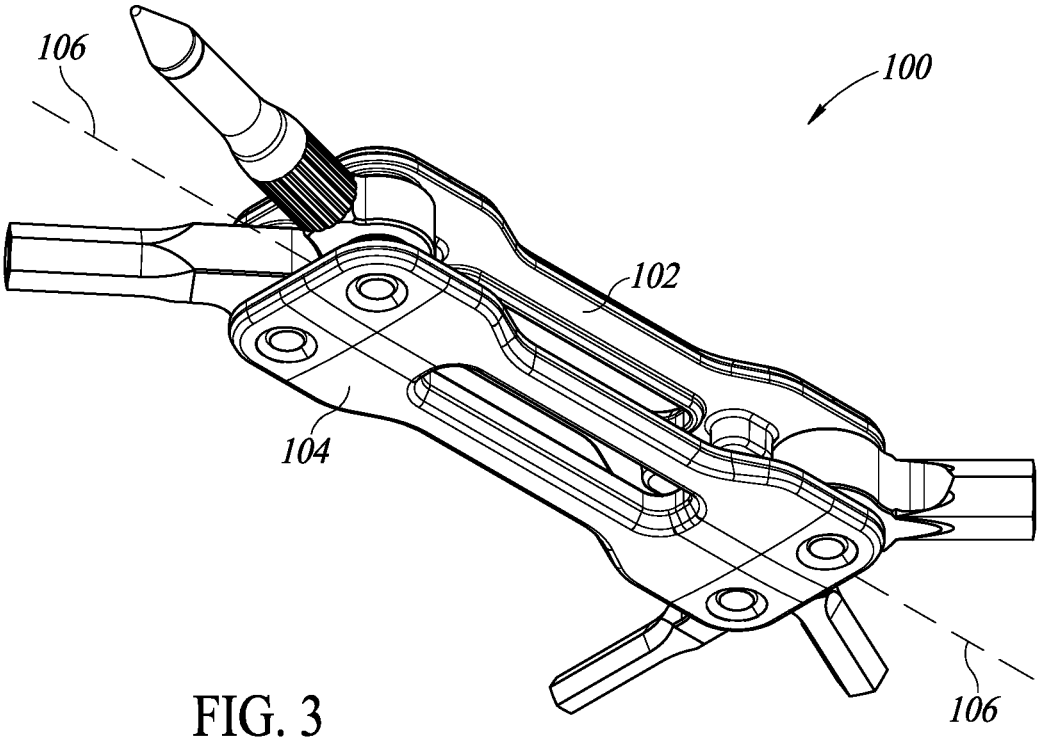
FIG. 3 illustrates a bottom perspective view of the multi-tool of FIG. 1 in an open configuration.
Figure 4:
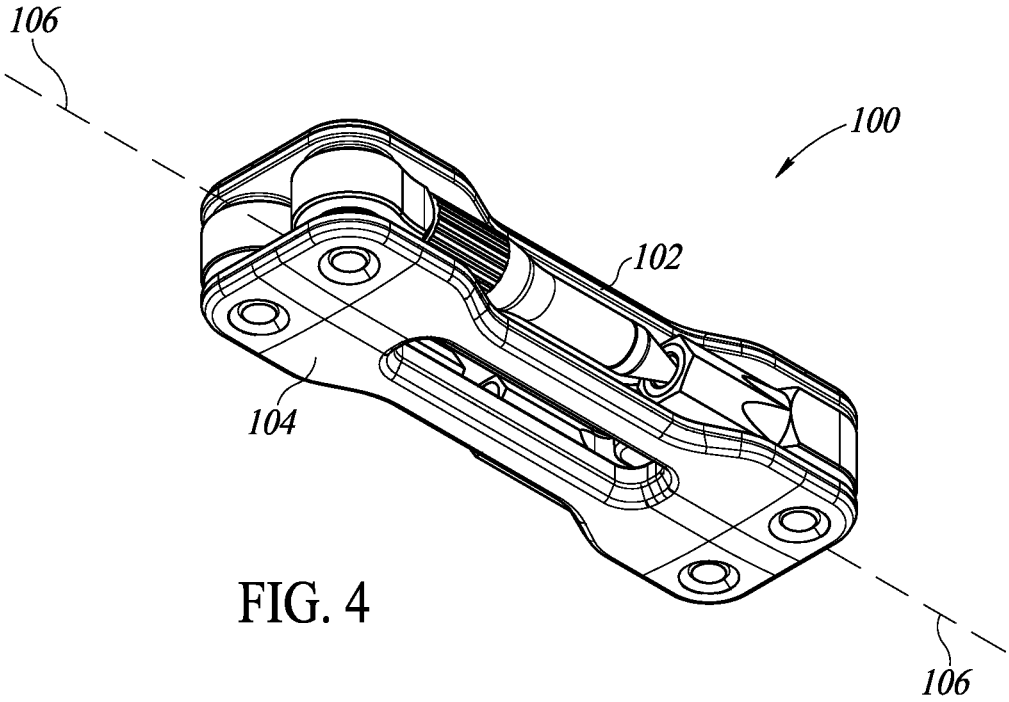
FIG. 4 illustrates a bottom perspective view of the multi-tool of FIG. 1 in a closed configuration.

FIG. 1 illustrates a front, left-side, and top perspective view of a multi-tool 100 in an open configuration, that is, with each of its individual tools rotated outward with respect to a main body of the multi-tool 100 and exposed therefrom, such that each of the individual tools are ready for use. As illustrated in FIG. 1, the main body of the multi-tool 100 includes a first plate 102, which may be referred to herein as a top plate 102, and a second plate 104, which may be referred to herein as a bottom plate 104. As also illustrated in FIG. 1, the multi-tool 100 has a central longitudinal axis 106 that extends side-to-side or left-to-right along a length of the multi-tool 100, in a direction parallel to lengths of the top and bottom plates 102 and 104, and in a direction perpendicular to an overall generally rectangular cross-sectional profile of the multi-tool 100 defined at least in part by outer surfaces of the top plate 102 and the bottom plate 104. FIG. 2 illustrates the same front, left-side, and top perspective view of the multi-tool 100 in a closed configuration, that is, with each of its individual tools rotated inward with respect to the main body of the multi-tool 100 and covered, such that none of the individual tools is ready for use. FIG. 3 illustrates a rear, right-side, and bottom perspective view of the multi-tool 100 in the open configuration, and FIG. 4 illustrates the same rear, right-side, and bottom perspective view of the multi-tool 100 in a closed configuration.

As used herein, terms of orientation or relative location such as "top," "bottom," "left," "right," "front," "rear," etc., are arbitrary labels used for the sake of convenience and clarity of the description herein. In fact, the entire multi-tool 100 can be positioned in any orientation while in storage, during transportation, or while in use, such that these labels are inherently arbitrary. In practical applications, the multi-tool 100 does not have a designated or required orientation, and can be used in different orientations such that a component labeled herein as "top" may in fact be at a bottom or a lateral side of the multi-tool 100. Further, in practical applications, the "left" and "right" ends and the "front" and "rear" sides of the multi-tool 100 may only be defined by a perspective of a viewer, such that the components to which such labels are assigned may change as the location of the viewer changes with respect to the multi-tool 100.

Nevertheless, the use of such terms is internally consistent herein. Further, in general, the multi-tool 100 is designed such that it can be positioned on a flat surface with its bottom plate 104 resting on the flat surface. Additionally, the top plate 102 has a logo, trademark, or other text 108 engraved in an upper surface thereof, which is intended to be seen by a viewer standing at the front of the multi-tool 100, thereby establishing the "front" and "rear" sides and the "left" and "right" ends of the multi-tool 100 for purposes of this disclosure. Furthermore, "lengths" of the components referred to herein generally refer to the longest outer rectilinear dimension of such components, which for the top plate 102 and the bottom plate 104 is in a direction parallel to the central longitudinal axis 106. Additionally, "inner" and "outer," as used herein, are to be understood as being with respect to a center of the multi-tool 100. The terms "proximal" and "distal," as used herein with respect to an individual tool of the multi-tool 100, are to be understood as being with respect to a hinge coupling the individual tool to the top plate 102 and the bottom plate 104, such that the hinge itself is at the proximal end of the individual tool.

Figure 5:
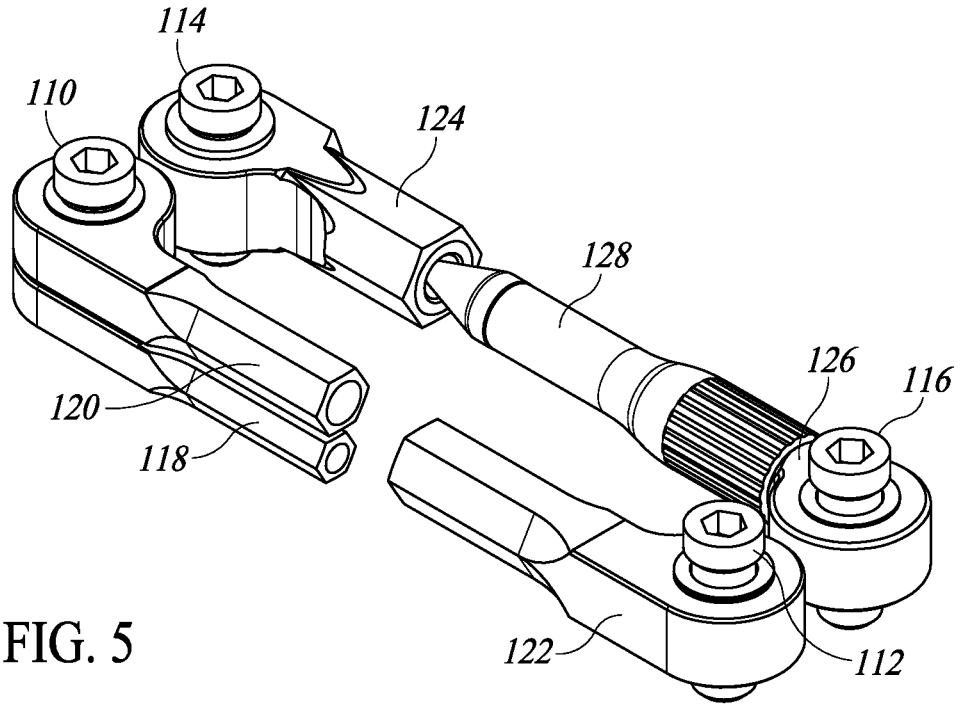
FIG. 5 illustrates a top perspective view of individual tools of the multi-tool of FIG. 1 in their closed configuration, or of the multi-tool of FIG. 1 in its closed configuration with top and bottom plates thereof removed.
Figure 6:
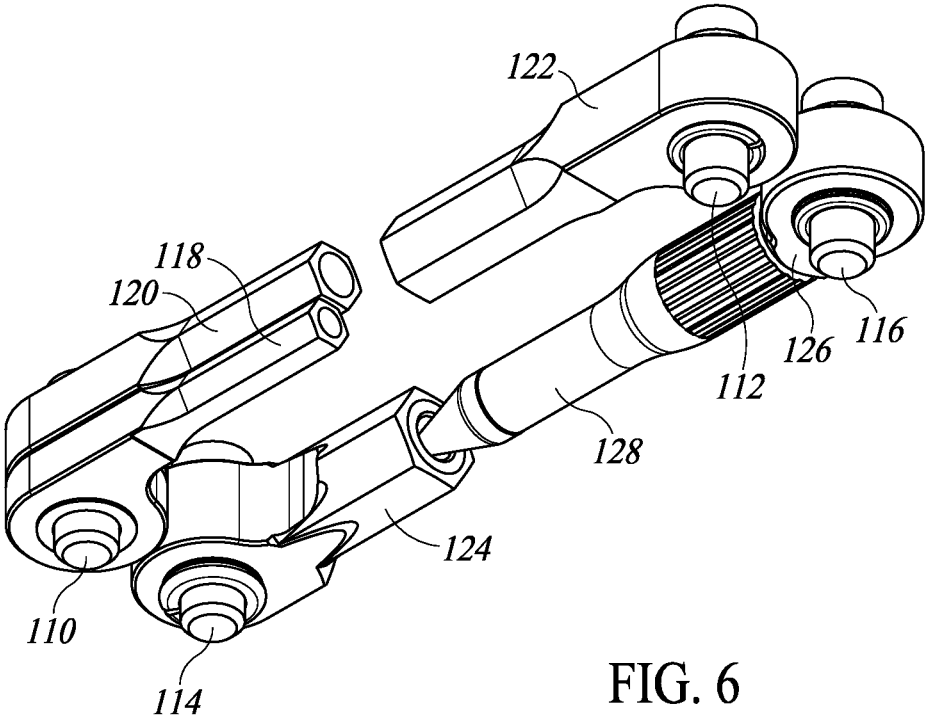
FIG. 6 illustrates a bottom perspective view of individual tools of the multi-tool of FIG. 1 in their closed configuration, or of the multi-tool of FIG. 1 in its closed configuration with top and bottom plates thereof removed.

FIG. 5 illustrates a top, right-side, and front perspective view of the individual tools of the multi-tool 100 in their closed configuration, that is, of the multi-tool 100 in its closed configuration with the top plate 102 and the bottom plate 104 removed. FIG. 6 illustrates a bottom, right-side, and front perspective view of the individual tools of the multi-tool 100 in their closed configuration, that is, of the multi-tool 100 in its closed configuration with the top plate 102 and the bottom plate 104 removed. As illustrated in FIGS. 5 and 6, the multi-tool 100 includes six distinct, individual tools coupled to the top plate 102 and the bottom plate 104 by four hinges, such that each of the individual tools can rotate with respect to the top plate 102 and the bottom plate 104 about a respective pivot axis that extends vertically up-and-down, directly from the top plate 102 to the bottom plate 104, and perpendicular to the central longitudinal axis 106 as well as to respective planes within which the top plate 102 and the bottom plate 104 sit.

In particular, FIGS. 5 and 6 illustrate that the multi-tool 100 includes a first hinge 110 at a first corner of the multi-tool 100, which is a front, left-side corner of the multi-tool 100, a second hinge 112 at a second corner of the multi-tool 100, which is a front, right-side corner of the multi-tool 100, a third hinge 114 at a third corner of the multi-tool 100, which is a rear, left-side corner of the multi-tool 100, and a fourth hinge 116 at a fourth corner of the multi-tool 100, which is a rear, right-side corner of the multi-tool 100. Each of the first, second, third, and fourth hinges 110, 112, 114, and 116 includes a respective elongate fastener such as a bolt, pin, or rod having a top end portion configured to extend through, be coupled to, and engage with a respective complementary aperture or opening in the top plate 102, a bottom end portion configured to extend through, be coupled to, and engage with a respective complementary aperture or opening in the bottom plate 104, and a shank or central portion configured to extend through a complementary hole, aperture, or opening in one or more of the individual tools of the multi-tool 100. In particular, the rods of each of the hinges 110, 112, 114, and 116 are configured to extend vertically up-and-down, directly from the top plate 102 to the bottom plate 104, and perpendicular to the central longitudinal axis 106 as well as to respective planes within which the top plate 102 and the bottom plate 104 sit, such that the pivot axes of the individual tools are coincident with central longitudinal axes of the rods of the hinges 110, 112, 114, and 116, and such that each of the individual tools can rotate with respect to the top plate 102 and the bottom plate 104 about a central longitudinal axis of a rod of a respective one of the hinges 110, 112, 114, and 116.

As further illustrated in FIGS. 5 and 6, the multi-tool 100 includes a first individual tool 118, which is a first hex-head screwdriver 118, and a second individual tool 120, which is a second hex-head screwdriver 120 that is larger than the first hex-head screwdriver 118. In some specific implementations, the first hex-head screwdriver 118 may be a 3 mm hex-head screwdriver and the second hex-head screwdriver 120 may be a 4 mm hex-head screwdriver. The first and second hex-head screwdrivers 118 and 120 have openings or apertures at respective proximal ends thereof through which the rod of the first hinge 110 extends. As illustrated in FIGS. 5 and 6, the second hex-head screwdriver 120 is positioned on top of or above the first hex-head screwdriver 118 on the rod of the first hinge 110. The first and second individual tools 118 and 120 are each configured to rotate outwards on the first hinge 110 with respect to the top plate 102 and the bottom plate 104, such as clockwise when viewed from above, and such as up to 180 degrees from their closed positions, such that the hex-head screwdrivers at the distal ends thereof are exposed from the main body of the multi-tool 100 and thus available for use, such as in repairing or otherwise working on a bicycle.

As further illustrated in FIGS. 5 and 6, the multi-tool 100 includes a third individual tool 122, which is a third hex-head screwdriver 122 that is larger than the first hex-head screwdriver 118 and the second hex-head screwdriver 120. In some specific implementations, the third hex-head screwdriver 122 may be a 5 mm hex-head screwdriver. The third hex-head screwdriver 122 has an opening or aperture at its proximal end through which the rod of the second hinge 112 extends. The third individual tool 122 is configured to rotate outwards on the second hinge 112 with respect to the top plate 102 and the bottom plate 104, such as counter-clockwise when viewed from above, and such as up to 180 degrees from its closed position, such that the hex-head screwdriver at the distal end thereof is exposed from the main body of the multi-tool 100 and thus available for use, such as in repairing or otherwise working on a bicycle. As also illustrated in FIGS. 5 and 6, when the multi-tool 100 is in a closed configuration, that is, when the individual tools of the multi-tool are rotated inwards on the respective hinges and covered by the top plate 102 and the bottom plate 104, the terminal distal end of the third hex-head screwdriver 122 faces, but is spaced apart from and does not interact with, the terminal distal ends of the first and second hex-head screwdrivers 118 and 120.

As further illustrated in FIGS. 5 and 6, the multi-tool 100 includes a fourth individual tool 124, which is a fourth hex-head screwdriver 124 that is larger than the first hex-head screwdriver 118, the second hex-head screwdriver 120, and the third hex-head screwdriver 122. In some specific implementations, the fourth hex-head screwdriver 124 may be a 6 mm hex-head screwdriver. The fourth hex-head screwdriver 124 has an opening or aperture at its proximal end through which the rod of the third hinge 114 extends. The fourth individual tool 124 is configured to rotate outwards on the third hinge 114 with respect to the top plate 102 and the bottom plate 104, such as counter-clockwise when viewed from above, and such as up to 180 degrees from its closed position, such that the hex-head screwdriver at the distal end thereof is exposed from the main body of the multi-tool 100 and thus available for use, such as in repairing or otherwise working on a bicycle. The fourth hex-head screwdriver 124 is illustrated further in FIGS. 12 and 13 and described further with respect to those figures and elsewhere herein.

As further illustrated in FIGS. 5 and 6, the multi-tool 100 includes a fifth individual tool 126, which is a hexalobular internal (sometimes referred to as "TORX") screwdriver 126, and a sixth individual tool 128, which is a tire repair tool 128. In some specific implementations, the hexalobular screwdriver 126 may have the size of a T25 TORX screwdriver. The hexalobular internal screwdriver 126 has an opening or aperture at a proximal end thereof through which the rod of the fourth hinge 116 extends. As illustrated in FIGS. 5 and 6, a distal end portion of the hexalobular internal screwdriver 126 is nested within a proximal portion of the tire repair tool 128, such that the tire repair tool 128 is not directly coupled to the fourth hinge 116, but is indirectly coupled to the fourth hinge 116 by the hexalobular internal screwdriver 126. Thus, the hexalobular internal screwdriver 126 may be referred to as a proximal, inner individual tool of the pair of nested tools coupled to the fourth hinge 116, and the tire repair tool 128 may be referred to as a distal, outer individual tool of the pair of nested tools coupled to the fourth hinge 116.

The fifth and sixth individual tools 126 and 128 are collectively configured to rotate together, in unison, outwards on the fourth hinge 116 with respect to the top plate 102 and the bottom plate 104, such as clockwise when viewed from above, and such as up to 180 degrees from their closed position, such that the hexalobular internal screwdriver head and/or the tire repair tool at the distal end portions thereof are exposed from the main body of the multi-tool 100 and thus available for use, such as in repairing or otherwise working on a bicycle. The hexalobular internal screwdriver 126 and the tire repair tool 128 are collectively illustrated further in FIG. 7 and described further with respect to that figure and elsewhere herein. The hexalobular internal screwdriver 126 is illustrated further in FIG. 8 and described further with respect to that figure and elsewhere herein. The tire repair tool 128 is illustrated further in FIGS. 9-11 and described further with respect to those figures and elsewhere herein.

Figure 7:
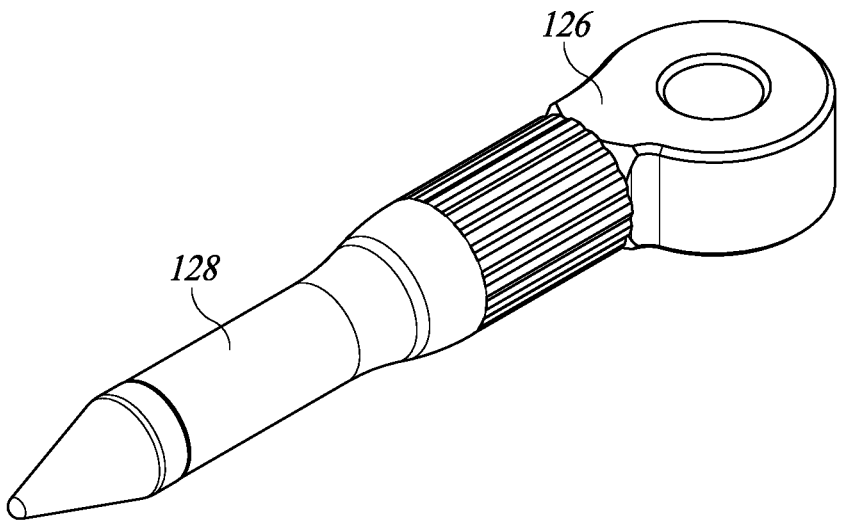
FIG. 7 illustrates a perspective view of a pair of nested individual tools of the multi-tool of FIG. 1.
Figure 8:
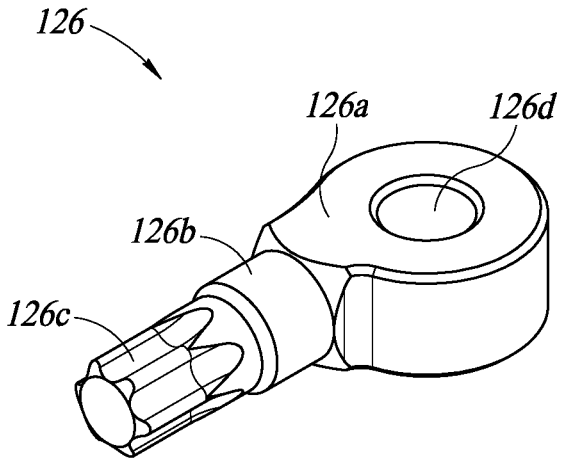
FIG. 8 illustrates a perspective view of a first, proximal, inner individual tool of the pair of nested tools of FIG. 7.

FIG. 7 illustrates the nested hexalobular internal screwdriver 126 and tire repair tool 128 separated from the rest of the multi-tool 100, and FIG. 8 illustrates the hexalobular internal screwdriver 126 separated from the rest of the multi-tool 100, including the tire repair tool 128. As illustrated in FIG. 8, the hexalobular internal screwdriver 126 includes a proximal portion 126*a* which includes the aperture or opening 126*d* through which the rod of the fourth hinge 116 is configured to extend. As also illustrated in FIG. 8, the hexalobular internal screwdriver 126 includes a distal portion 126*c* which includes the hexalobular head of the hexalobular internal screwdriver 126 that is configured to nest within the proximal portion of the tire repair tool 128. As further illustrated in FIG. 8, the hexalobular internal screwdriver 126 includes an intermediate portion 126*b* located between the proximal portion 126*a* and the distal portion 126*c*, and which couples the proximal portion 126*a* to the distal portion 126*c*. An outer surface of the intermediate portion 126*b* may be threaded such that a proximal portion of the tire repair tool 128 including complementary threads may be threaded onto and thereby securely coupled to the hexalobular internal screwdriver 126, as described further elsewhere herein with respect to the tire repair tool 128.

Figure 9:
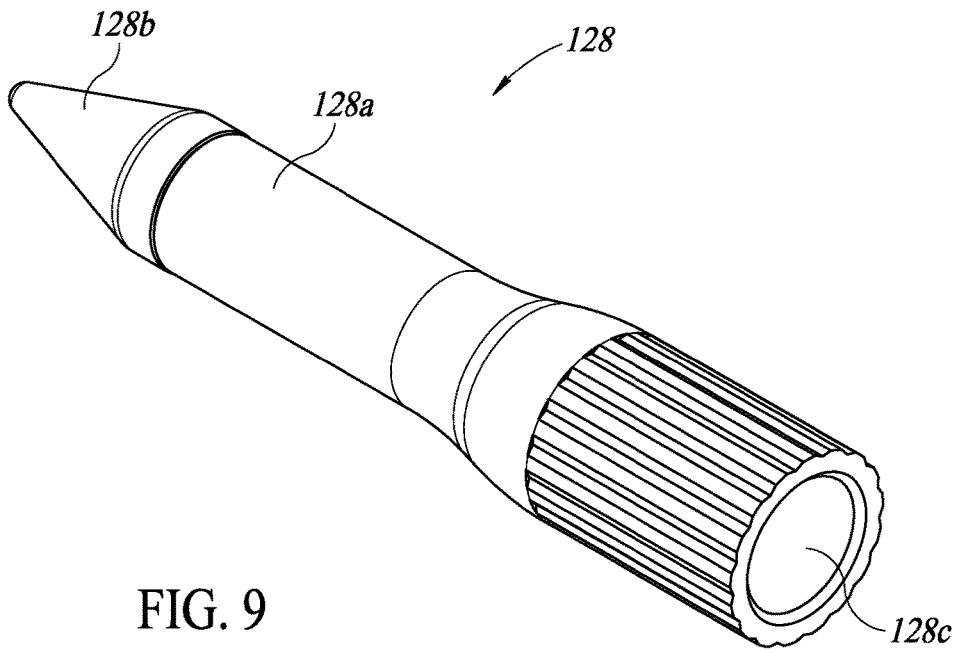
FIG. 9 illustrates a perspective view of a second, distal, outer individual tool of the pair of nested tools of FIG. 7.

FIG. 9 illustrates the tire repair tool 128 separated from the rest of the multi-tool 100, including the hexalobular internal screwdriver 126. As illustrated in FIG. 9, the tire repair tool 128 includes a proximal portion 128*a*, which includes a hollow cylindrical tube 128*a*, and a distal portion 128*b*, which includes a generally conical tip 128*b* extending distally from a distal end of the tube 128*a*. The conical tip 128*b* may be made of metal, rigid plastic, or other relatively rigid and strong materials. As further illustrated in FIG. 9, a proximal portion of an inner surface 128*c* of the tube 128*a* may be threaded and have threads complementary to the threads formed on the outer surface of the intermediate portion 126*b* of the hexalobular internal screwdriver 126, such that a proximal end of the tire repair tool 128 including the threads may be threaded onto and thereby securely coupled to the intermediate portion 126*b* of the hexalobular internal screwdriver 126, such as by the threads thereof, and such that the intermediate portion 126*b* and the distal portion 126*c* of the hexalobular internal screwdriver are positioned inside the hollow cylindrical tube 128*a*. Thus, an operator can readily couple the tire repair tool 128 to the hexalobular internal screwdriver 126 and/or remove the tire repair tool 128 from the hexalobular internal screwdriver 126. In some embodiments, any of the other tools described herein, such as any one, two, three, or all four of the other tools, may be replaced by one or more other tools, which may be coupled to one another by complementary threads, as described herein for the tire repair tool 128 and the hexalobular internal screwdriver 126.

Figure 10:
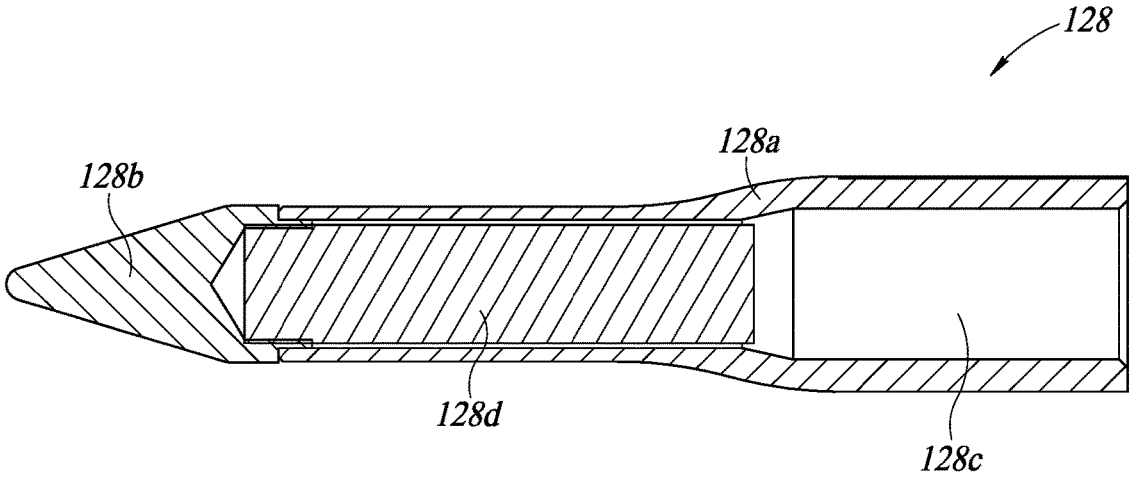
FIG. 10 illustrates a cross-sectional view of the second, distal, outer individual tool of FIG. 9.
Figure 11:
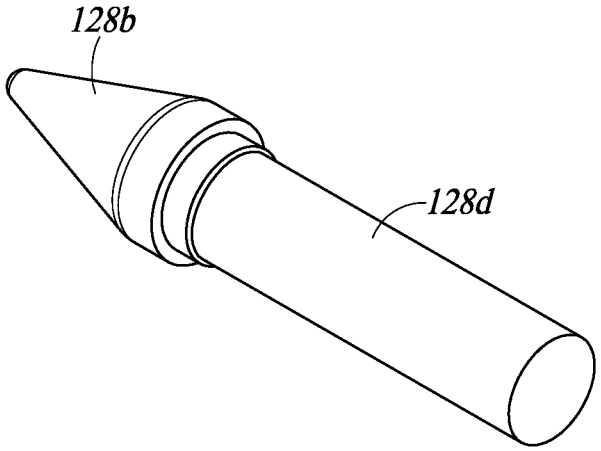
FIG. 11 illustrates a perspective view of components of the second, distal, outer individual tool of FIG. 9.

FIG. 10 illustrates a cross-sectional view of the tire repair tool 128. As illustrated in FIG. 10, the tire repair tool 128 further includes a plug 128*d* securely coupled to the conical tip 128*b* and positioned within a distal portion of the tube 128*a*. The plug 128*d* may include an elongated rubberized cord or other rubber-impregnated plug, and may be coated in a sticky or adhesive material. FIG. 11 illustrates the conical tip 128*b* and the plug 128*d* of the tire repair tool 128 separated from the rest of the multi-tool 100, including the hexalobular internal screwdriver 126 and the tube 128*a* of the tire repair tool 128. A method of repairing a tire using the tire repair tool 128 may include inserting the tire repair tool 128, including its conical tip 128*b*, tube 128*a*, and plug 128*d*, into a puncture or other aperture or failure site in a tire. For example, a user may manually push the tire repair tool 128 through a puncture in a tire. As the user does so, a distal end portion of the tube 128*a* abuts against a proximal end portion of the conical tip 128*b* and pushes the conical tip 128*b* into the tire while the plug 128*d* is protected within the tube 128*a* and behind or proximal to the conical tip 128*b*.

The user may then pull on the multi-tool 100 to retract the tire repair tool 128 from the tire. As the user does so, the tube 128*a*, which is securely coupled to the rest of the multi-tool 100 by the threads and hinge as described elsewhere herein, is pulled out of the puncture, but the conical tip 128*b* remains trapped within the tire because it is not securely fastened to the tube 128*a* or the rest of the multi-tool 100, and so is not pulled out of the tire with the rest of the tool 128. The plug 128*d* remains coupled to the conical tip 128*b* and therefore in position and extending through the puncture in the tire, thereby plugging or sealing the puncture. A portion of the plug remaining outside the tire may be trimmed away so that it does not interfere with operation of the repaired tire. In some embodiments, the tire repair tool may be manufactured and supplied by Dynaplug (see, e.g., http://www.dynaplug.com/). Additional information regarding such tire repair tools and their use may be found in U.S. Pat. No. 8,707,829. In other embodiments, however, the tire repair tool may be manufactured and/or supplied by any other manufacturer and/or supplier. In yet other embodiments, the tire repair tool may be replaced by any other suitable tool.

Figure 12:
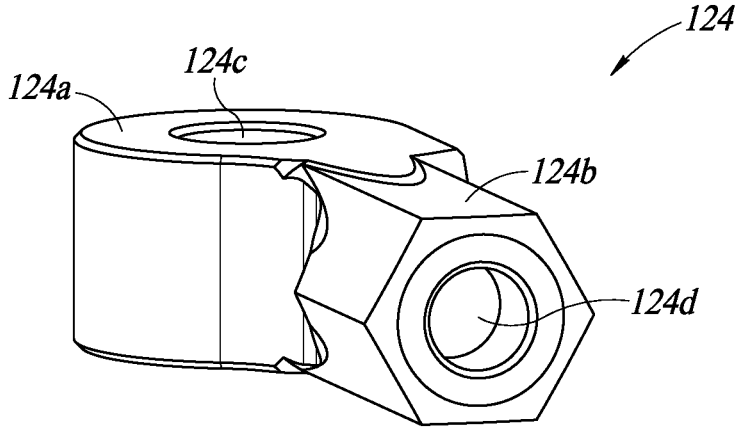
FIG. 12 illustrates a perspective view of another individual tool of the multi-tool of FIG. 1.
Figure 13:
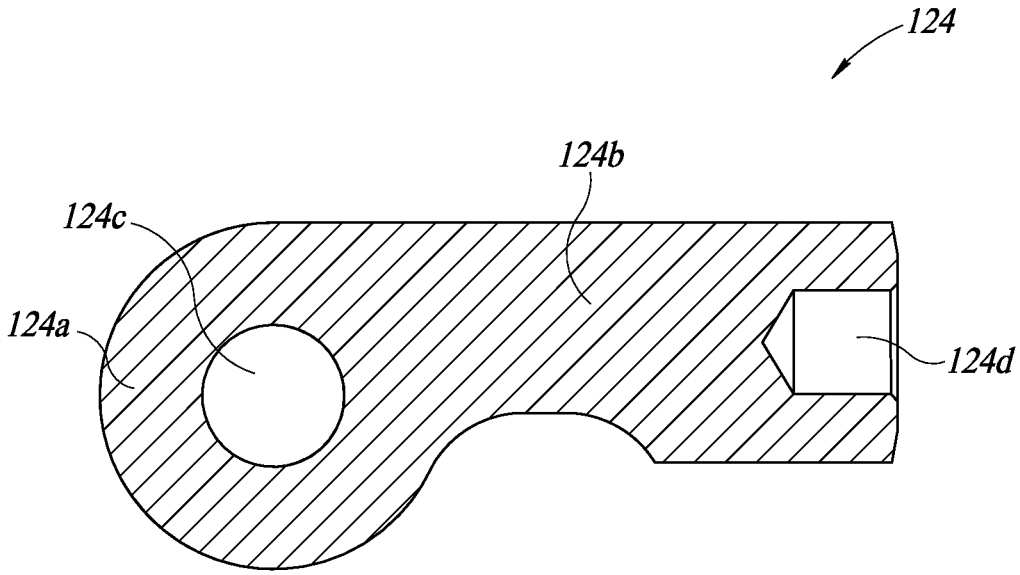
FIG. 13 illustrates a cross-sectional view of the individual tool of FIG. 12.

FIG. 12 illustrates a perspective view of the fourth hex-head screwdriver 124 separated from the rest of the multi-tool 100. As illustrated in FIG. 12, the fourth hex-head screwdriver 124 includes a proximal portion 124*a* which includes the aperture or opening 124*c* through which the rod of the third hinge 114 is configured to extend. As also illustrated in FIG. 12, the fourth hex-head screwdriver 124 includes a distal portion 124*b* which includes the head of the fourth hex-head screwdriver 124. As further illustrated in FIG. 12, the distal portion 124*b* of the fourth hex-head screwdriver 124 includes a recess or a bore 124*d* formed in a terminal distal end thereof that extends longitudinally inward into the terminal distal end of the distal portion 124*b* of the fourth hex-head screwdriver 124, such as along a proximal-distal axis. FIG. 13 illustrates a cross-sectional view of the fourth hex head screwdriver 124. As illustrated in FIG. 13, the bore 124*d* includes a cylindrical outer, distal, or top portion, and a conical inner, proximal, or bottom portion.

As illustrated in FIGS. 4-6, when the multi-tool 100 is in the closed configuration, that is, when the individual tools of the multi-tool 100 are rotated inwards on the respective hinges and covered by the top plate 102 and the bottom plate 104, the distal end of the fourth hex-head screwdriver 124 and the distal end of the tire repair tool 128 face toward and mechanically engage with one another. In particular, when the multi-tool 100 is in the closed configuration, a distal portion of the conical tip 128*b* of the tire repair tool 128 is located within the recess or bore 124*d* formed in the distal end portion of the fourth hex-head screwdriver 124, such as within the cylindrical and/or the conical portion thereof. Such features allow the multi-tool 100 to have a smaller overall profile than a multi-tool without such features. Such features also inhibit or prevent inadvertent opening of the multi-tool 100 and rotation of the individual tools thereof outward from the top plate 102 and the bottom plate 104. Such features also make opening and closing the multi-tool 100 more complex, because the fourth hex-head screwdriver 124 and the tire repair tool 128 are opened and/or closed together, that is, rotated away from or toward one another simultaneously, to ensure that the distal portion of the conical tip 128*b* of the tire repair tool 128 leaves or seats within the recess or bore 124*d* formed in the distal end portion of the fourth hex-head screwdriver 124, such as within the cylindrical and/or the conical portion thereof.

Such features can help to ensure that the plug 128*d* of the tire repair tool 128 is not inadvertently pulled out of the tube 128*a*, such as before it is inserted into a puncture in a tire to repair the tire.

Figure 14:
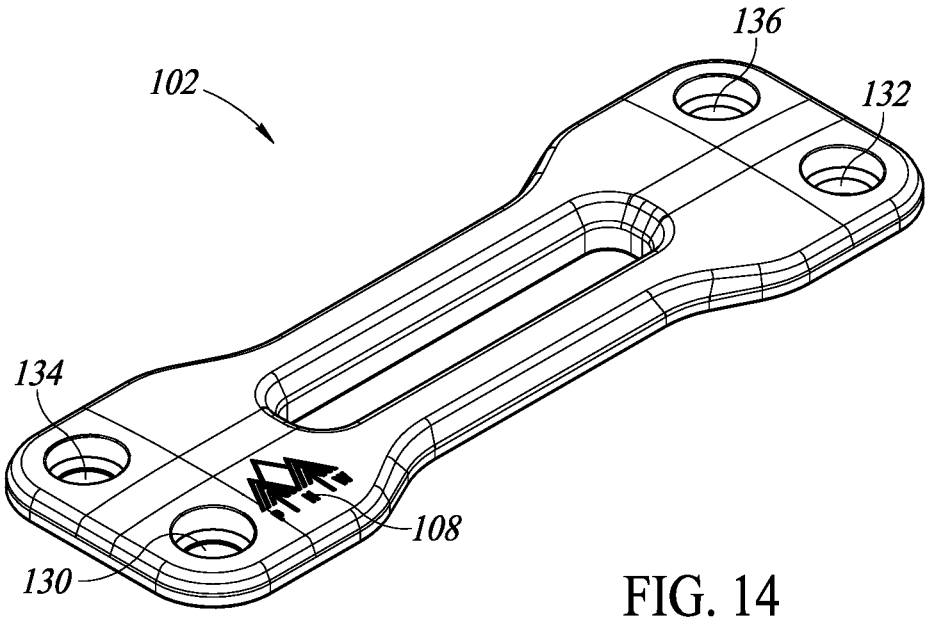
FIG. 14 illustrates a top perspective view of a top plate of the multi-tool of FIG. 1.
Figure 15:
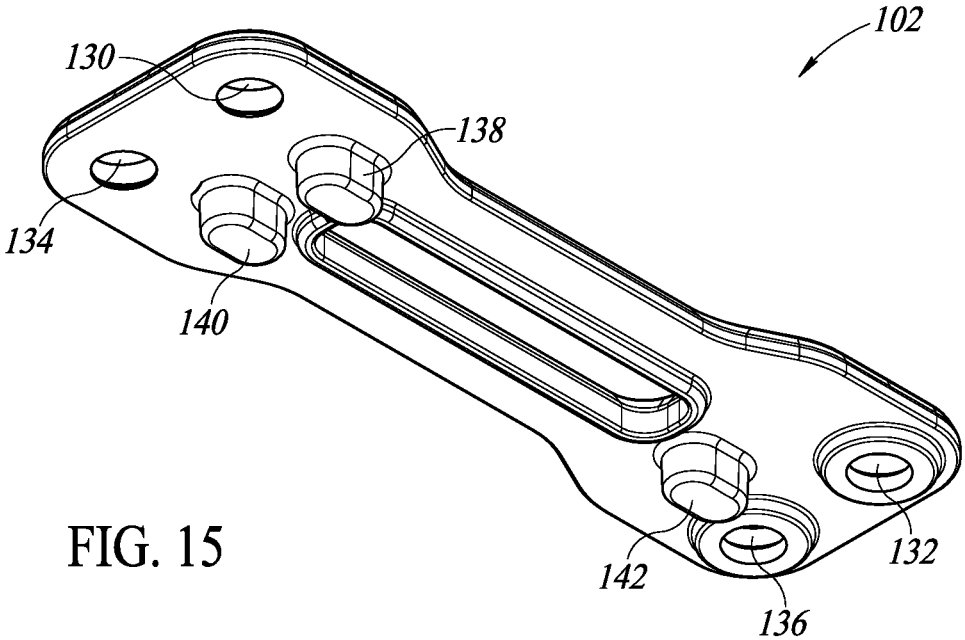
FIG. 15 illustrates a bottom perspective view of the top plate of FIG. 14.

FIG. 14 illustrates a top perspective view of the top plate 102 and FIG. 15 illustrates a bottom perspective view of the top plate 102. As illustrated in FIGS. 14 and 15, the top plate 102 includes a first aperture 130 formed in a front, left-side corner thereof that is configured to receive the rod of the first hinge 110, a second aperture 132 formed in a front, right-side corner thereof that is configured to receive the rod of the second hinge 112, a third aperture 134 formed in a rear, left-side corner thereof that is configured to receive the rod of the third hinge 114, and a fourth aperture 136 formed in a rear, right-side corner thereof that is configured to receive the rod of the fourth hinge 116. As further illustrated in FIG. 15, the top plate 102 also includes a first ridge or protrusion 138 extending outward and downward from the bottom surface of the top plate 102 adjacent or proximate to the first aperture 130. The first protrusion 138 is configured and positioned to provide a hard stop for the second hex-head screwdriver 120 that stops rotation of the second hex-head screwdriver 120 inward toward the main body of the multi-tool 100, such as when the head or distal end portion of the second hex-head screwdriver 120 is aligned with or parallel to the axis 106.

As further illustrated in FIG. 15, the top plate 102 also includes a second ridge or protrusion 140 extending outward and downward from the bottom surface of the top plate 102 adjacent or proximate to the third aperture 134. The second protrusion 140 is configured and positioned to provide a hard stop for the fourth hex-head screwdriver 124 that stops rotation of the fourth hex-head screwdriver 124 inward toward the main body of the multi-tool 100, such as when the head or distal end portion of the fourth hex-head screwdriver 124 is aligned with or parallel to the axis 106. As further illustrated in FIG. 15, the top plate 102 also includes a third ridge or protrusion 142 extending outward and downward from the bottom surface of the top plate 102 adjacent or proximate to the fourth aperture 136. The third protrusion 142 is configured and positioned to provide a hard stop for the hexalobular internal screwdriver 126 and the tire repair tool 128 that stops rotation of the hexalobular internal screwdriver 126 and the tire repair tool 128 inward toward the main body of the multi-tool 100, such as when a central longitudinal axis of the tire repair tool 128 is aligned with or parallel to the axis 106.

Figure 16:
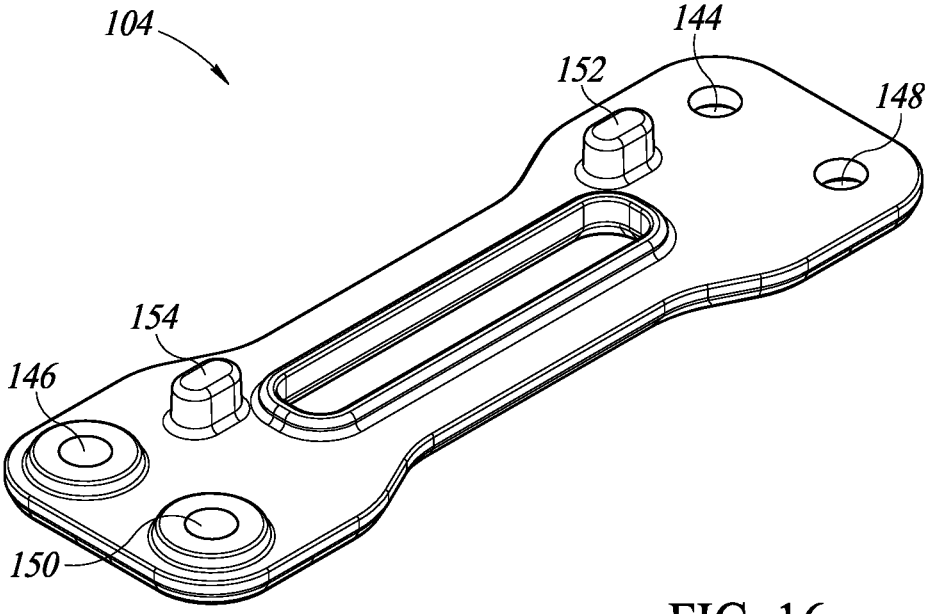
FIG. 16 illustrates a top perspective view of a bottom plate of the multi-tool of FIG. 1.
Figure 17:
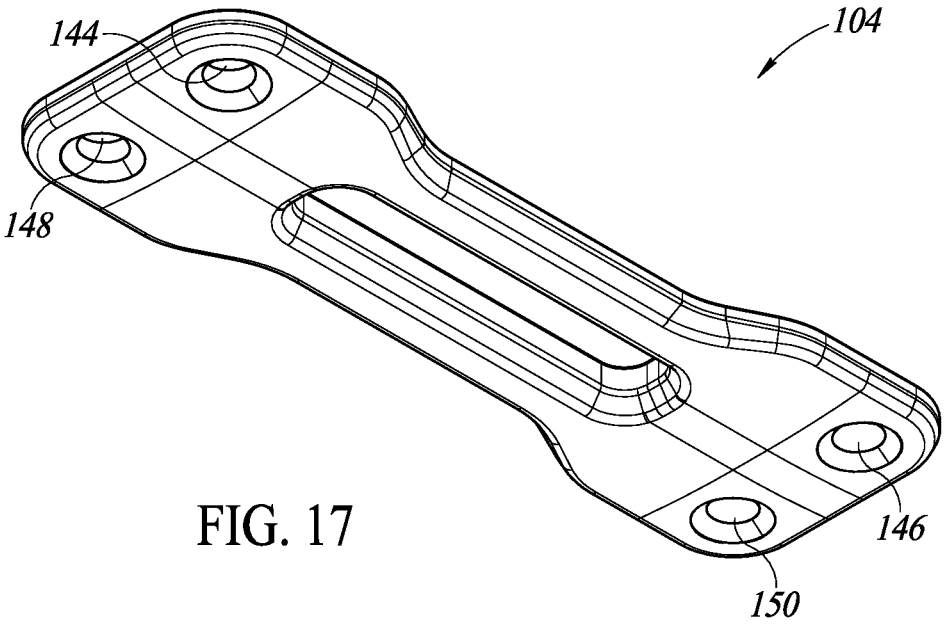
FIG. 17 illustrates a bottom perspective view of the bottom plate of FIG. 16.

FIG. 16 illustrates a top perspective view of the bottom plate 104 and FIG. 17 illustrates a bottom perspective view of the bottom plate 104. As illustrated in FIGS. 16 and 17, the bottom plate 104 includes a first aperture 144 formed in a front, left-side corner thereof that is configured to receive the rod of the first hinge 110, a second aperture 146 formed in a front, right-side corner thereof that is configured to receive the rod of the second hinge 112, a third aperture 148 formed in a rear, left-side corner thereof that is configured to receive the rod of the third hinge 114, and a fourth aperture 150 formed in a rear, right-side corner thereof that is configured to receive the rod of the fourth hinge 116.

As further illustrated in FIG. 16, the bottom plate 104 also includes a first ridge or protrusion 152 extending outward and upward from the upper surface of the bottom plate 104 adjacent or proximate to the first aperture 144. The first protrusion 152 is configured and positioned to provide a hard stop for the first hex-head screwdriver 118 that stops rotation of the first hex-head screwdriver 118 inward toward the main body of the multi-tool 100, such as when the head or distal end portion of the first hex-head screwdriver 118 is aligned with or parallel to the axis 106. As further illustrated in FIG. 16, the bottom plate 104 also includes a second ridge or protrusion 154 extending outward and upward from the upper surface of the bottom plate 104 adjacent or proximate to the second aperture 146. The second protrusion 154 is configured and positioned to provide a hard stop for the third hex-head screwdriver 122 that stops rotation of the third hex-head screwdriver 122 inward toward the main body of the multi-tool 100, such as when the head or distal end portion of the third hex-head screwdriver 122 is aligned with or parallel to the axis 106.

In some specific implementations, the top plate 102 and/or the bottom plate 104 may be made, e.g., forged, from any one of various suitable metal materials. Although the tire repair tool 128 is described herein in the specific context of repairing a bicycle tire, the tire repair tool 128 in other implementations may be used to repair any tire, such as a tire of a motorcycle, an automobile, a truck, or a piece of heavy-duty equipment. Although the tire repair tool 128 is described herein as being threaded onto the hexalobular internal screwdriver 126, various other connections can be used to allow a user to efficiently couple the tire repair tool 128 to the hexalobular internal screwdriver 126 or to remove the tire repair tool 128 therefrom, such as bayonet-style connections, detent-style connections, magnetic connections, etc.

In some embodiments, a multi-tool may include a first tire repair tool, such as the tire repair tool 128, and a second tire repair tool, which may be larger or smaller than (e.g., have a different thickness or gauge than) the tire repair tool 128. For example, a multi-tool may have a larger form factor than the multi-tool 100 and may include twice as many individual tools as the multi-tool 100, including a first, larger tire repair tool and a second, smaller tire repair tool.

In some embodiments, the multi-tool 100 may be provided as a part of a kit that includes a plurality of different tire repair tools, including the tire repair tool 128. For example, such a kit may include a plurality of tire repair tools of a wide variety of different sizes. As one other example, multiple tire repair tools similar to the tire repair tool 128 described herein may be used to plug a single large puncture in a tire. For example, a method of repairing a tire using multiple tire repair tools may include coupling a first tire repair tool onto the hexalobular internal screwdriver 126, as described further elsewhere herein. The method may further include inserting the first tire repair tool into a puncture or other aperture or failure site in a tire, as described further elsewhere herein. The method may further include retracting the first tire repair tool, including the outer tube thereof, from the tire, leaving the conical tip thereof trapped within the tire and the plug thereof extending through the puncture, thereby at least partially plugging, sealing, or otherwise repairing the puncture, as described further elsewhere herein. The method may further include removing the components of the first tire repair tool still coupled to the hexalobular internal screwdriver 126 from the hexalobular internal screwdriver 126, as described further elsewhere herein.

The method may further include coupling a second tire repair tool onto the hexalobular internal screwdriver 126, as described further elsewhere herein. The method may further include inserting the second tire repair tool into the puncture or other aperture or failure site in the tire, as described further elsewhere herein. The method may further include retracting the second tire repair tool, including the outer tube thereof, from the tire, leaving the conical tip thereof trapped within the tire and the plug thereof extending through the puncture, thereby at least partially plugging, sealing, or otherwise repairing the puncture, as described further elsewhere herein. The method may further include removing the components of the second tire repair tool still coupled to the hexalobular internal screwdriver 126 from the hexalobular internal screwdriver 126, as described further elsewhere herein. This process can be repeated as many times as needed until the puncture or other failure is completely plugged, sealed, or otherwise repaired. Portions of the plugs remaining outside the tire may then be trimmed away so that they do not interfere with operation of the repaired tire.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A multi-tool, comprising:

a first individual tool rotatable with respect to a main body of the multi-tool from a closed position of the first individual tool to an open position of the first individual tool, wherein the first individual tool is a tire repair tool and includes a conical tip at a distal end portion of the tire repair tool; and a second individual tool rotatable with respect to the main body of the multi-tool from a closed position of the second individual tool to an open position of the second individual tool;

wherein, when the first individual tool is in the closed position of the first individual tool and the second individual tool is in the closed position of the second individual tool, a distal end portion of the first individual tool is located inside a distal end portion of the second individual tool and the conical tip of the tire repair tool is seated within the distal end portion of the second individual tool.

2. The multi-tool of claim 1 wherein, when the first individual tool is in the closed position of the first individual tool and the second individual tool is in the closed position of the second individual tool, the distal end portion of the first individual tool is mechanically engaged with the distal end portion of the second individual tool.

3. The multi-tool of claim 1 wherein the tire repair tool includes a hollow tube and a plug, the plug located inside the hollow tube and securely coupled to the conical tip.

4. The multi-tool of claim 1 wherein the second individual tool is a hex-head screwdriver.

5. The multi-tool of claim 1 wherein:

the second individual tool has a distal end surface and a recess formed in the distal end surface; and when the first individual tool is in the closed position of the first individual tool and the second individual tool is in the closed position of the second individual tool, the distal end portion of the first individual tool is located inside the recess.

6. A multi-tool, comprising:

a first individual tool rotatable with respect to a main body of the multi-tool from a closed position of the first individual tool to an open position of the first individual tool, wherein the first individual tool is a tire repair tool; and a second individual tool rotatable with respect to the main body of the multi-tool from a closed position of the second individual tool to an open position of the second individual tool, wherein the second individual tool is a hex-head screwdriver;

wherein, when the first individual tool is in the closed position of the first individual tool and the second individual tool is in the closed position of the second individual tool, a distal end portion of the first individual tool is located inside a distal end portion of the second individual tool;

wherein the multi-tool includes four hex-head screwdrivers and a hexalobular internal screwdriver.

7. A multi-tool, comprising:

a first individual tool rotatable with respect to a main body of the multi-tool from a closed position of the first individual tool to an open position of the first individual tool, wherein the first individual tool is a tire repair tool; and a second individual tool rotatable with respect to the main body of the multi-tool from a closed position of the second individual tool to an open position of the second individual tool;

wherein, when the first individual tool is in the closed position of the first individual tool and the second individual tool is in the closed position of the second individual tool, a distal end portion of the first individual tool is located inside a distal end portion of the second individual tool;

wherein the multi-tool includes a hexalobular internal screwdriver and a distal end portion of the hexalobular internal screwdriver is nested within a proximal end portion of the tire repair tool.

8. The multi-tool of claim 7 wherein the tire repair tool is threaded onto the hexalobular internal screwdriver.

9. The multi-tool of claim 8 wherein:

the hexalobular internal screwdriver has a proximal portion directly coupled by a hinge to the main body of the multi-tool;

the distal end portion of the hexalobular internal screwdriver includes a hexalobular internal screwdriver head;

the hexalobular internal screwdriver has an intermediate portion that couples the proximal portion of the hexalobular internal screwdriver to the distal end portion of the hexalobular internal screwdriver, wherein the intermediate portion has an external surface including first threads; and the tire repair tool includes a hollow tube and a plug inside the hollow tube, wherein the hollow tube has an internal surface including second threads complementary to the first threads.

10. A multi-tool, comprising: a first individual tool coupled to a first end of the multi-tool and rotatable with respect to a main body of the multi-tool from a closed position of the first individual tool to an open position of the first individual tool; and a second individual tool coupled to a second end of the multi-tool opposite to the first end of the multi-tool and rotatable with respect to the main body of the multi-tool from a closed position of the second individual tool to an open position of the second individual tool, wherein the second individual tool has a distal end surface and a recess formed in the distal end surface, wherein the recess includes a distal cylindrical portion and a proximal conical portion; wherein, when the first individual tool is in the closed position of the first individual tool and the second individual tool is in the closed position of the second individual tool, a distal end portion of the first individual tool is located inside the recess of the second individual tool.

11. A method of using a multi-tool including a main body, a first individual tool rotatable with respect to the main body, wherein the first individual tool is a first tire repair tool, and a second individual tool rotatable with respect to the main body, the method comprising:

rotating the first individual tool to a closed position of the first individual tool and rotating the second individual tool to a closed position of the second individual tool until a distal end portion of the first tire repair tool is located inside a distal end portion of the second individual tool;

rotating the first individual tool to an open position of the first individual tool and rotating the second individual tool to an open position of the second individual tool until the distal end portion of the first tire repair tool is not located inside the distal end portion of the second individual tool;

inserting the distal end portion of the first tire repair tool into a puncture in a tire; and retracting the first tire repair tool from the tire, leaving the distal end portion of the first tire repair tool inside the tire and a first plug of the first tire repair tool inside the puncture.

12. The method of claim 11 wherein rotating the first individual tool to a closed position of the first individual tool and rotating the second individual tool to a closed position of the second individual tool includes simultaneously rotating the first individual tool and the second individual tool.

13. The method of claim 11 wherein rotating the first individual tool to the open position of the first individual tool and rotating the second individual tool to the open position of the second individual tool includes simultaneously rotating the first individual tool and the second individual tool.

14. The method of claim 11, further comprising:

removing a hollow tube of the first tire repair tool from the multi-tool; and coupling a second tire repair tool to the multi-tool.

15. The method of claim 14, further comprising:

inserting a distal end portion of the second tire repair tool into the puncture in the tire; and retracting the second tire repair tool from the tire, leaving the distal end portion of the second tire repair tool inside the tire and a second plug of the second tire repair tool inside the puncture.

16. The method of claim 15, further comprising trimming a portion of the first plug outside the tire and a portion of the second plug outside the tire.

* * * * *